US008167007B2

(12) United States Patent
Gustafsson

(10) Patent No.: US 8,167,007 B2
(45) Date of Patent: May 1, 2012

(54) DEVICE FOR FILLING CONTAINERS OF COLLAPSIBLE TYPE

(75) Inventor: Per Gustafsson, Bjarred (SE)

(73) Assignee: Ecolean Research & Development A/S, Copenhagen (DK)

( * ) Notice: Subject to any disclaimer, the term of this patent is extended or adjusted under 35 U.S.C. 154(b) by 483 days.

(21) Appl. No.: 12/444,512

(22) PCT Filed: Oct. 25, 2007

(86) PCT No.: PCT/SE2007/000940

§ 371 (c)(1),
(2), (4) Date: Apr. 6, 2009

(87) PCT Pub. No.: WO2008/051151

PCT Pub. Date: May 2, 2008

(65) Prior Publication Data

US 2010/0037987 A1 Feb. 18, 2010

(30) Foreign Application Priority Data

Oct. 26, 2006 (SE) ..... 0602259

(51) Int. Cl.
*B67C 3/26* (2006.01)

(52) U.S. Cl. ..... 141/264; 141/114; 141/314; 141/317

(58) Field of Classification Search ..... 141/64, 141/114, 263, 264, 301, 313–315, 317, 346, 141/369, 372, 374
See application file for complete search history.

(56) References Cited

U.S. PATENT DOCUMENTS

| | | | | |
|---|---|---|---|---|
| 2,715,004 | A * | 8/1955 | Fox | 248/101 |
| 2,874,734 | A * | 2/1959 | Luckock et al. | 141/87 |
| 4,832,096 | A * | 5/1989 | Kohlbach | 141/114 |
| 6,810,931 | B2 * | 11/2004 | Graffin | 141/301 |
| 6,925,711 | B2 * | 8/2005 | Kilmer et al. | 29/890.053 |
| 2007/0074783 | A1 * | 4/2007 | Stocchi | 141/264 |

FOREIGN PATENT DOCUMENTS

| | | | |
|---|---|---|---|
| EP | 0 643 011 | A | 10/1988 |
| EP | 1 340 713 | A | 9/2003 |
| EP | 1 588 948 | A | 10/2005 |
| GB | 2 190 901 | A | 12/1987 |
| JP | 09-095303 | A | 4/1997 |
| WO | 99/41149 | A | 8/1999 |
| WO | 99/41155 | | 8/1999 |
| WO | 2006/132578 | | 12/2006 |

* cited by examiner

*Primary Examiner* — Gregory Huson
*Assistant Examiner* — Jason Niesz
(74) *Attorney, Agent, or Firm* — Volpe and Koenig, P.C.

(57) ABSTRACT

The invention relates to a device for filling a container of a collapsible type with a product. The device comprising a valve housing with a filling tube, which is insertable into a filling duct of the container to supply the product to the compartment through a product path; a piston element arranged in the product path and comprising a valve body and an end element, the piston element being movable between a first position, in which the valve body blocks the product path and the end element counteract dripping, and a second position, in which the valve body opens the product path and the end element defines, together with the outlet portion, a filling passage; and a squeezing apparatus establishes a seal between the filling tube and the filling duct.

19 Claims, 4 Drawing Sheets

DEVICE FOR FILLING CONTAINERS OF COLLAPSIBLE TYPE

FIELD OF THE INVENTION

The present invention relates to a device for filling a container of a collapsible type with a product in the form of powder or liquid, and more specifically such a device which comprises a filling tube, which is insertable into a filling duct of the container to supply a product to the compartment of the container through said filling tube.

BACKGROUND ART

Many different types of container to be filled with products in the form of liquid or powder are currently available.

One type of container is collapsible and comprises two flexible side walls and a bottom wall, which walls are interconnected along a connecting portion to form a compartment whose volume is dependent on the relative position of the walls.

This type of container can, before filling, be in a plane and sealed state. This makes it possible to sterilise the compartment of the container in connection with manufacture and, with maintained sterility, distribute the container to a filling plant, such as a dairy.

A container of the type described above is known from WO99/41155 which also discloses a device for filling the container.

Said device comprises a nozzle which is insertable into a filling duct of the container, said filling duct being opened by cutting or a similar operation in connection with filling of the container.

During the actual filling process, said nozzle is thus inserted into the filling duct, after which a product valve is opened to supply the desired product quantity to the compartment of the container through said nozzle. The compartment will then take a volume which substantially corresponds to the volume of the supplied product. The filling process ensures that intrusion of air into the compartment is prevented or at least minimised.

The filling device disclosed in WO99/41155 comprises more specifically a nozzle which is made of an elastic material, such as silicone rubber. The nozzle has an end portion which tapers towards an outlet in the form of a gap in the lower end surface of the end portion.

The nozzle is self-closing, which means that the edge portions which define said gap engage each other in the absence of application of outer forces.

During the filling process, the nozzle is, as mentioned above, inserted into the filling duct of the container, after which the product is supplied to the compartment through said nozzle. The product pressure will act to open the nozzle and at the same time to establish a seal between the nozzle and the walls of the filling duct to ensure that air does not enter the container.

Increasing demands are placed on the efficiency of filling devices of the type described above and, thus, also on the speed at which the device allows filling of an individual container.

Faster filling can be achieved with an increased product flow velocity, which results in a higher product pressure. It has been found that an increased product pressure may in some cases result in the product being pressed out of the compartment of the container between the nozzle and the walls of the filling duct. For obvious reasons, this causes problems in maintaining a hygienic environment in the filling device.

There is thus a need for a filling device which allows efficient and rational filling of containers of a collapsible type.

SUMMARY OF THE INVENTION

In view of that stated above, it is an object of the present invention to provide a device for filling containers of a collapsible type, which device allows fast filling under hygienic conditions.

To achieve this object, and also other objects that will be evident from the following description, a device with the features defined in claim 1 is provided according to the present invention. Embodiments of the device will be defined in claims 2-19.

More specifically, according to the present invention a device is provided for filling a container of a collapsible type with a product in the form of powder or liquid, said container having a compartment which is defined by flexible walls and whose volume is dependent on the relative position of the walls and which communicates with the surroundings through a filling duct of the container, comprising a valve housing with a filling tube, which is insertable into said filling duct of the container to supply a product to the compartment of the container through a product path which is defined by the valve housing and its filling tube, a piston element arranged in the product path and comprising a valve body and, arranged downstream thereof, an end element, the piston element being movable between a first position, in which the valve body abuts against a valve seat of the valve housing to block the product path and the end element is arranged in or adjacent to an outlet portion of the filling tube to counteract dripping, and a second position, in which the valve body is displaced from the valve seat to open the product path and the end element takes a position, in which it defines, together with the outlet portion, a filling passage, and a squeezing means which is arranged to grip the filling tube and the filling duct when said filling tube is inserted in said filling duct to establish a seal between the filling tube and the filling duct, said filling tube being made of a rigid material.

The inventive device ensures that a container of a collapsible type can be filled in a short time without the risk of the product escaping from the container.

The use of a valve body makes it possible to provide a relatively large area of the filling passage, which in turn enables a fast filling process.

A further advantage of the inventive device is that dripping can be counteracted by the end element when the piston element is arranged in the first position, which means that the valve body need not be arranged in or adjacent to the outlet portion. This also gives the advantage that the valve body does not have to project from the filling tube during filling of a container and thus risk to collide with parts that might damage the valve body. It also results in the advantage that the containers can be filled without dripping, which is more hygienic.

An additional advantage is that the filling tube need not be inserted very far into the container since the squeezing means seals against the filling tube, which reduces the wetting of the device. By wetting is meant that the product comes into contact with parts of the device.

The piston element may further comprise a piston rod, the piston rod supporting the valve body and the end element. This results in the advantage that the piston element can be manufactured in a simple and inexpensive way. It also results in the advantage that the valve body and the end element can easily be moved synchronously.

In order to further simplify the movement of the piston element, it may be movable between said first and second positions by axial displacement of said piston element.

The end element can be exchangeably arranged in said piston element, which results in the advantage that only the end element has to be exchanged if, while being moved, it is damaged, for example by bumping into some other part. The fact that the end element is exchangeable also brings the advantage that the down-time during a stoppage can be reduced, which results in great cost savings.

The end element being arranged downstream of the valve body also brings the advantage that the risk of it being damaged is minimised.

The valve body may be exchangeably arranged in said piston element.

The end element may be received in the outlet portion of the filling tube where the piston element is arranged in the first position, which brings the advantage that the risk of the end element, or some other part of the device, being damaged by collision or unintentional engagement with other machinery parts during operation, is minimised.

In order to further increase the outlet area of the product path, the end element may project from the outlet portion of the filling tube when the piston element is arranged in the second position.

A favourable way of providing a large outlet area may be that the filling passage has the form of a circumferential gap.

The valve body may support a seal, which, when the valve body is arranged in said first position, abuts against the valve seat. This ensures that the valve body sealingly engages with the valve seat when the piston element is in the first position.

The end element may have the form of a truncated cone with a tapered end facing away from the outlet, which brings the advantage that the flow of a product flowing through the device changes direction when the product touches the end element. More specifically, the end element may be given such a truncated conical shape that the flow of product flowing out is diverted and laterally directed outward towards the connecting portion of the container on each side. Then the flow will follow the wall and be collected at the bottom of the container. This provides filling from below upwards and this flow reduces frothing and turbulence of the product and means that a container can be filled more quickly without splashes of the product and without spillage.

In order to further increase the flow in the lateral direction and increase the area of the filling passage, the circumferential surface of the truncated conical shape of the end element may be curved.

The end element may have a flat surface facing away from the filling tube, which brings the advantage that the risk of the end element bumping into some other part is further minimised.

The flat surface of the end element may have a profiled surface structure. The advantage of a profiled surface structure is that the capillary force of a liquid which is located on the surface increases, which in turn reduces the risk of drops forming and dripping from the end element. It should be mentioned that by a profiled surface structure is meant a surface which is, for instance, knurled, rough, irregular etc, that is a surface structure which generates a greater capillary force than a completely flat surface structure.

The end element may have a circular base or a base with the shape of a convex lens. An end element having the form of a truncated cone and with a base with the shape of a convex lens promotes the above described flow pattern in the lateral direction.

The filling tube can be made of stainless steel.

The squeezing means may comprise elastic engaging surfaces which are arranged to grip said filling tube and said filling duct. This results in the advantage that the squeezing means can gently grip said filling tube and filling duct while at the same time a reliable seal is established.

The valve housing and its filling tube may further have a gas duct for supplying a gas to the container. This results in the advantage that, in addition to a product, also a gas can be supplied to the container in a simple and inexpensive manner, for instance a gas which is adapted to extend the life of the product.

To allow the gas to be supplied in the correct quantity and at the correct point of time in the filling process, the supply of gas can be arranged to be controlled independently of the position of the piston element.

BRIEF DESCRIPTION OF THE DRAWINGS

Embodiments of the present invention will in the following be described by way of example with reference to the accompanying drawings.

DESCRIPTION OF EMBODIMENTS

The present invention relates to a device for filling a container of a collapsible type.

A container of this type may comprise two opposite side walls and a bottom wall, which walls are interconnected along a connecting portion and define a compartment whose volume is dependent on the relative position of the walls. A filling duct of the container, which filling duct can be defined by said side walls, makes its compartment communicate with the surroundings. In the unfilled state of the container, the filling duct can be sealed, in which case the duct is opened before filling. This makes it possible to ensure in a simple way that containers with sterile compartments are used in the inventive device.

Figure 1:
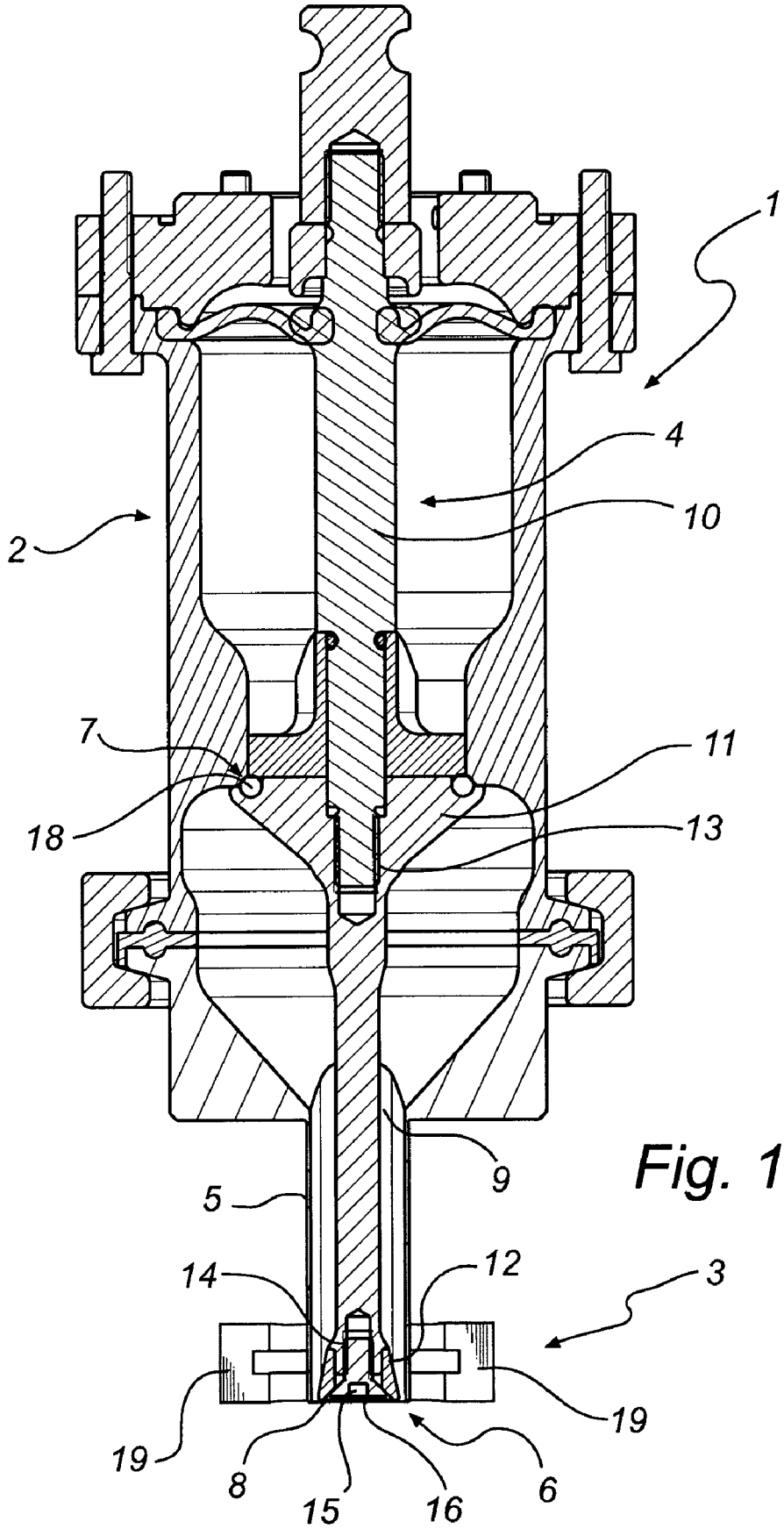
FIG. 1 is a cross-sectional view of an embodiment of an inventive device.

FIG. 1, to which reference is now made, illustrates an embodiment of an inventive device 1, for filling the above described container.

The device 1 comprises as main components a valve housing 2, a squeezing means 3 and a piston element 4.

The valve housing 2 is connected to a source (not shown) for the product that is to be supplied to the container. The valve housing 2 comprises a filling tube 5 with an outlet portion 6, and a valve seat 7. The outlet portion 6 of the filling tube 5 has an outlet 8. The valve housing 2 and the filling tube 5 define a product path 9.

The piston element 4 comprises a piston rod 10 which supports a valve body 11 and, arranged downstream thereof, an end element 12. In the embodiment shown, the piston rod is divided into two parts. In the embodiment shown, the valve body 11 has a shape that substantially corresponds to a cone tapered in the product flow direction. At the upper end thereof, a threaded hole 13 is formed, into which is screwed a first part of the piston rod 10. A second part of the piston rod 10 is formed integrally with the valve body 11. A second threaded hole 14 is formed at the lower end of the second part of the piston rod. The end element 12 has the form of a truncated cone and has a central through hole 15. The end element 12 is exchangeably arranged on the second part of the piston rod 10 by means of a screw 16 which extends through the central through hole 15 and is screwed into the second threaded hole 14 of the piston rod 10.

The piston element 4 is arranged in the product path 9 and is movable between a first position as shown in FIG. 1, in which the valve body 11 abuts against the valve seat 7 of the valve housing 2 to block the product path 9 and the end element 12 is arranged in or adjacent to the outlet portion 6 of the filling tube 5 to counteract dripping, and a second position, in which the valve body 11 is displaced from the valve seat 7 to open the product path 9 and the end element 12 takes a position, in which it defines, together with the outlet portion 6, a filling passage 17.

The valve body 11 supports a seal 18 in the form of an O-ring 18. In said first position, said O-ring 18 abuts against the valve seat 7 of the valve housing 2 to ensure that the valve body 11 sealingly connects to said valve seat 7.

The piston element 4 is supported in said valve housing 2 and is axially displaceable by a suitably designed arrangement, and by displacing said piston element 4 in the axial direction, the piston element 4 is thus movable between said first and second positions.

In the first position, the end element 12 is received in the filling tube 5. The end element 12 has an outer diameter which is slightly smaller than the inner diameter of the filling tube 5 and thus does not abut against the filling tube 5. If there is liquid between the valve body 11 and the end element 12 when the piston element 4 is in the first position, dripping from the device 1 is counteracted by the capillary force of the product generated between the end element 12 and the filling tube 5. The suitable difference in diameter between the end element 12 and the inner diameter of the filling tube 5 is thus due to which product is to be supplied to the container. It should be emphasised that the shape of the end element 12 and the inner side of the filling tube 5 is not limited to circular shapes, but they can have a number of suitable shapes.

In the shown embodiment, the squeezing means 3 comprises a pair of jaws 19, which are arranged to grip the filling tube 5.

The filling tube 5 is made of a rigid material, such as stainless steel, and the pair of jaws 19 have elastic engaging surfaces 20.

Figure 2A:
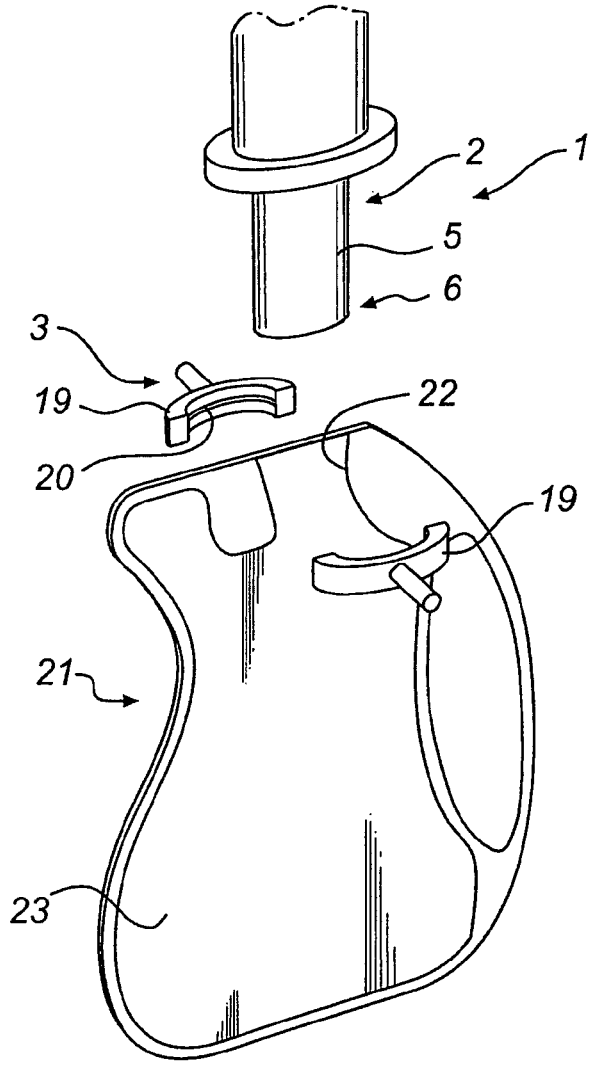
FIGS. 2*a*-2*b* are schematic perspective views which illustrate the method of filling a container by means of an inventive device.
Figure 2B:
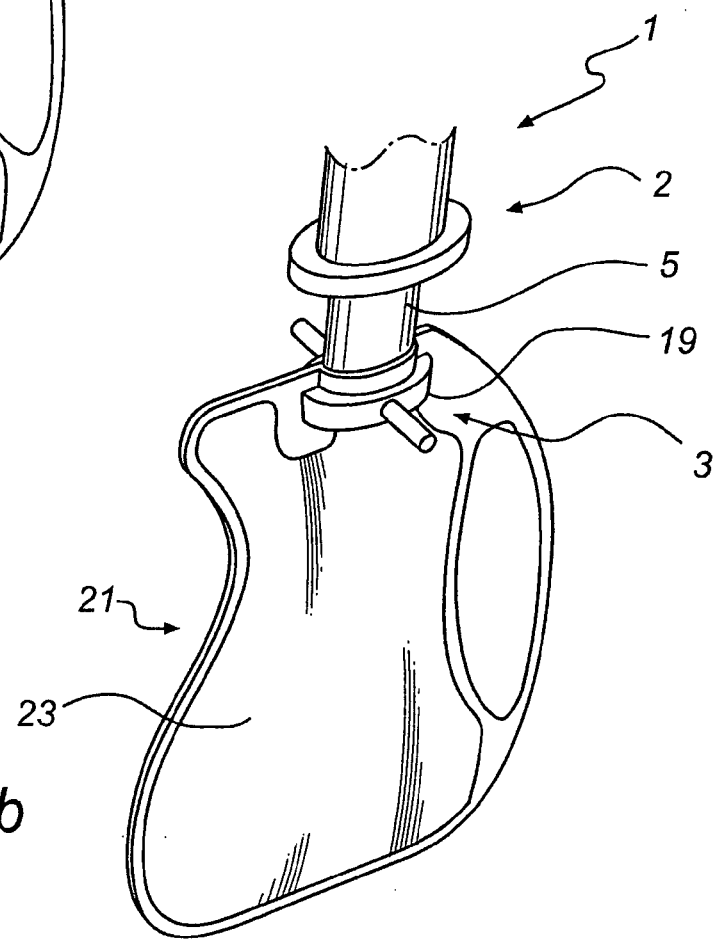

FIGS. 2*a* and 2*b*, to which reference is now made, illustrate the method of filling a container 21.

As shown in FIG. 2*a*, first a container 21 is positioned under the inventive device 1. The filling duct 22 of the container 21 has been opened by cutting or the like operation, whereby the compartment 23 of the container 21 communicates with the surroundings through said filling duct 22.

The positioning of containers 21 can be performed in various ways, for instance by means of an arrangement of laterally movable gripping means, from which the containers are suspended (not shown).

In FIG. 2*b*, the filling tube 5 is inserted in the filling duct 22 of the container 21 with the piston element 4 in its first position. The squeezing means 3 has been activated so that its pair of jaws 9 grip the filling tube 5 and thus also the filling duct 22. Since the filling tube 5 is made of a rigid material while the engaging surfaces of the pair of jaws are elastic, a reliable seal is established between said filling duct 22 and the filling tube 5, which does not risk damaging the side walls of the container 21, which define said filling duct 22.

Figure 3B:
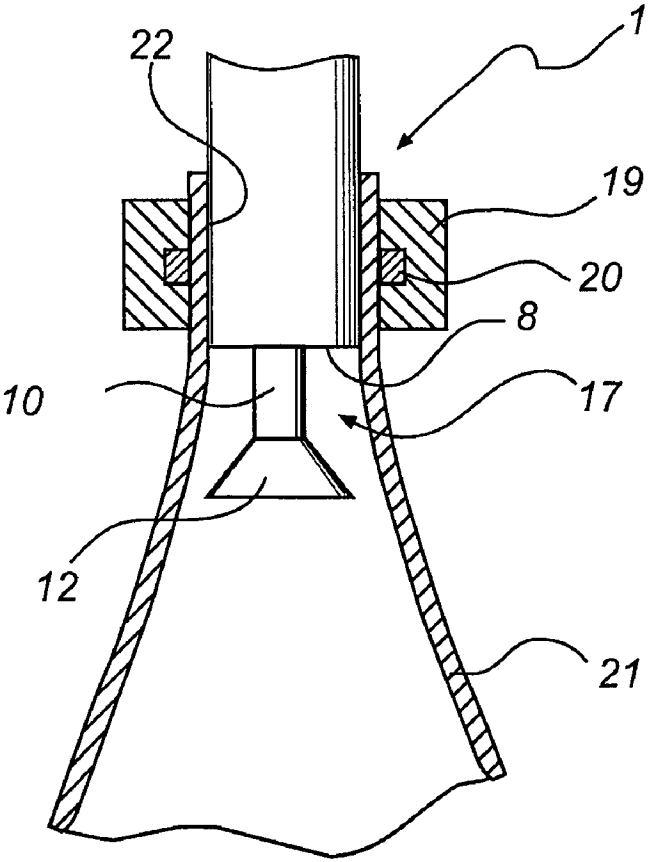
FIGS. 3*a*-3*b* are schematic cross-sectional views which illustrate the operation of a valve element of the inventive device during the method of filling shown in FIGS. 2*a*-2*b*.
Figure 3A:
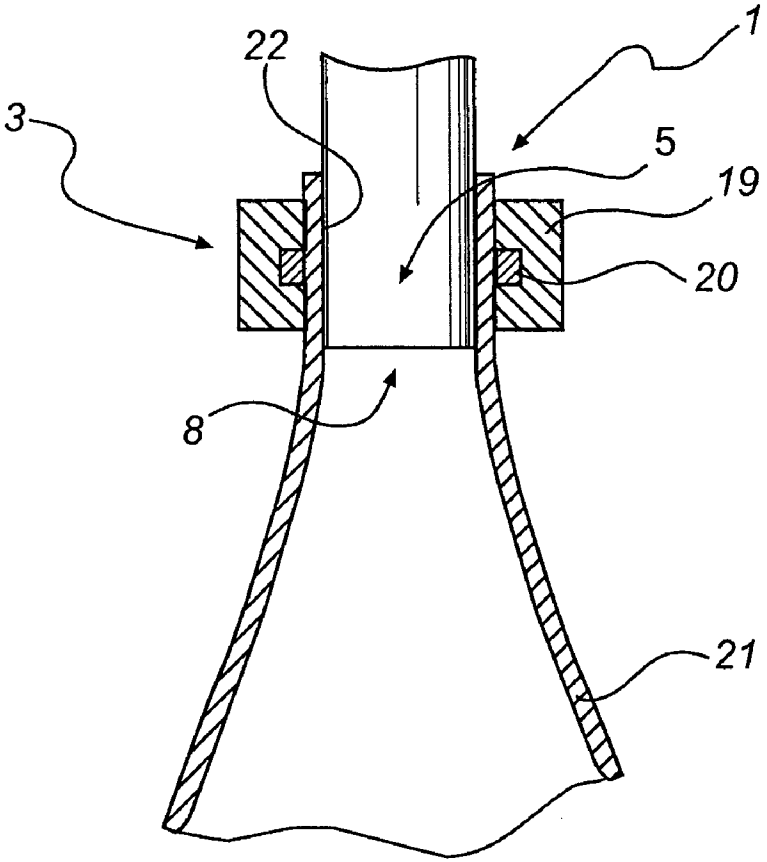

As mentioned above, the piston element 4 is in its first position when the filling tube 5 is being inserted into the filling duct 22 of the container 21, which is shown more distinctly in FIG. 3*a*.

When the squeezing means 3 has been activated so that its pair of jaws 19 grip the filling duct 22 and the filling tube 5, the piston element 4 and its piston rod 10 can be moved to its second position, which is partly to be seen in FIG. 3*b*, and the valve body 11 opens the product path. The product will then flow out of the thus defined filling passage 17 and into the compartment 23 of the container 21. During filling, the compartment 23 of the container 21 will be expanded in response to the entering of the product, like a balloon being inflated. The seal provided by the squeezing means 3 ensures that the product cannot be pressed out of the container 21 between the filling duct 22 and the filling tube 5.

In the shown embodiment, the shape of the end element 12 helps the product flowing out of the device 1 and into a container flow in the lateral direction to the side walls of the container. As the product touches the side walls of the container, its direction changes once more and then it flows along the walls down to the bottom of the container. Finally, the product is collected at the bottom of the container and the container is filled from below. It has been found that this flow is advantageous when filling containers of a collapsible type. The flow causes frothing and turbulence in the product to decrease, which in turn results in less wetting of the container and less splashing. In order to further promote the flow to the side walls of the container, the conical shape of the end element 12 can have a curved circumferential surface.

An end element 12 having a conical shape with a curved circumferential surface also has the advantage that the filling passage of the device 1 will be greater since the distance between the outlet portion 6 of the filling tube 5 and the end element increases.

The filling process is terminated by the piston element 4 again being moved to its first position, after which the pair of jaws 19 of the squeezing means 3 are opened and the filling tube 5 is pulled out of the filling duct 22 of the container 21. To reduce the risk of pressure drop and frothing when terminating the filling process, the movement of the piston element 4 to its first position can be controlled in such a manner that it is moved step by step or relatively slowly. Then the filling duct 22 can be sealed in a convenient manner, for instance by a heat sealing process.

The product which, when the piston element 4 is in its first position, is located between the valve body 11 and the end element 12 is prevented from dripping out of the device due to capillary force. This capillary force arises because the end element 12 and the inside of the filling tube 5 are positioned at a distance from each other that is suitable for the product, such that a gap forms between them. It should also be mentioned that the invention is not limited to capillary force to prevent dripping. For instance, the end element can thus be arranged to abut sealingly against the outlet portion in said first position.

It will be appreciated that the entire filling tube 5 need not be inserted into the filling duct, but it is sufficient that the outlet portion 6 thereof is inserted into the filling duct 22. This brings the advantage that the wetting of the device can be minimised, which is advantageous from the hygienic point of view.

It will be appreciated that the time required for filling a container 21 with the product in question is due to, on the one hand, the flow velocity of the product and on the other the filling passage and the valve body. By the piston element 4 being movable between said first and second positions, said area can be adjusted as desired by moving the valve body 11 of the piston element 4 to a suitable position between said first and said second position. In particular the inventive device 1 makes it possible to provide a relatively large area of the filling passage 17, which for obvious reasons has a positive effect on the filling time for a container 21. It should be noted in the context that the squeezing means 3 ensures that the quick filling of the container 21 can be provided without the product escaping from the compartment 23 of the container 21.

The valve body 11 can be designed in various ways and need not be restricted to the dimensions of the filling tube 5 since the valve body is not limited to be arranged in the filling tube 5.

Also the end element 12 can be designed in various ways. The end element 12 illustrated in FIG. 1 comprises an upper part in the form of a truncated cone. The end element 12 further has a central through hole 15 to be exchangeably mounted on said valve body 11 by means of a screw.

A piston element 4 designed in the way described above, that is an end element that does not protrude, thus has a shape that minimises the risk of one part bumping into another machine part during operation as the filling tube 5 is repeatedly moved into and out of the filling duct of a container, and being damaged. An opening means (not shown) can be arranged to initially separate the walls of the filling duct 22. This opening means may comprise suction cups which stick to the respective duct walls, which suction cups are then separated for separation of the duct walls.

The end element's 12 form of a truncated cone in the shown embodiment ensures that the product flowing out of the filling tube 5 through the filling passage 17 is allowed to flow over the end element 12 in a streamlined manner. This eliminates, or in any case reduces, the tendency of the product flowing out to touch the upper side of the end element 12 and be deflected upwards.

Figure 4:
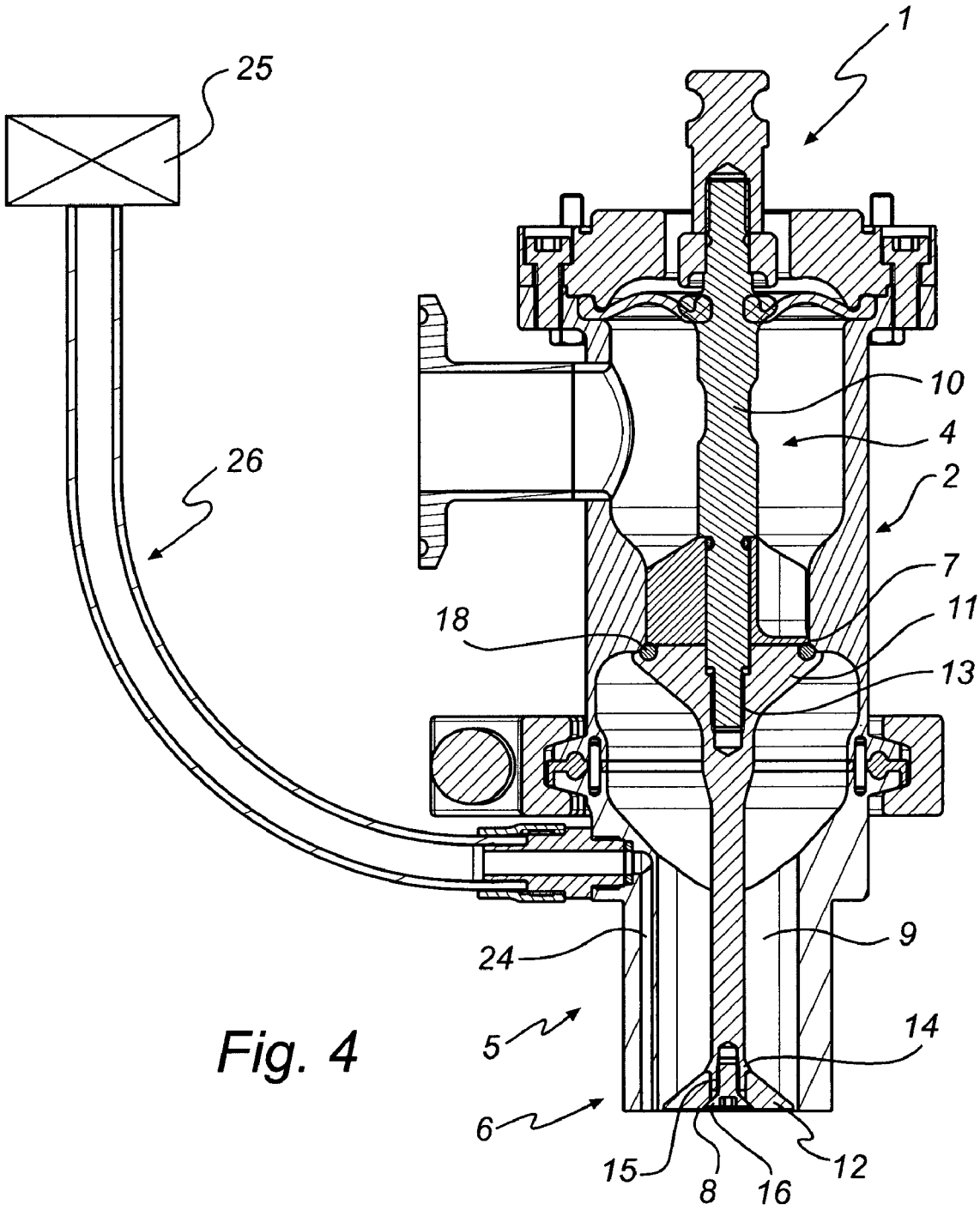
FIG. 4 is a cross-sectional view of a second embodiment of an inventive device.

With reference to FIG. 4, a second embodiment of an inventive device will now be described. The device in FIG. 4 comprises, in addition to that included in the device in FIG. 1, a gas duct 24, a gas valve 25 and a gas supplying device 26.

The gas duct 24 extends through a wall of the filling tube 5 and the valve housing 2. The upper end of the gas duct 24 is connected to the gas supplying device 26. The lower end of the gas duct 24 opens adjacent to the outlet 8 of the filling tube 5. The gas supplying device 26 is connected to the gas valve 25 and, thus, gas can flow through the gas valve 25, the gas supplying device 26 and the gas duct 24.

When the filling tube 5 is being inserted into a filling duct of a container, thus also the lower opening of the gas duct 24 is inserted into the filling duct. When opening the gas valve 25, gas flows from the gas valve 25 through the gas supplying device 26 and the gas duct 24 and into the container during, before and/or after filling the container with a product. The reason why a gas is supplied to the container may be, for instance, to extend the life of the product.

It will be appreciated that the present invention is not restricted to the embodiments illustrated.

To prevent the product from depositing on the walls of the filling duct in connection with removal of the filling tube 5, this can alternatively be dimensioned in such a manner relative to the filling duct that removal of the filling tube 5 is allowed without contact with the walls of said filling duct.

It is also conceivable to give the end element 12 a different shape.

The end element is not restricted to be fixed to the piston element by means of a screw, but it can be attached in many different ways.

Several modifications and variations are thus feasible, which means that the present invention is exclusively defined by the appended claims.

The invention claimed is:

1. A device for filling a container of a collapsible type with a product in the form of powder or liquid, said container having a compartment which is defined by flexible walls and whose volume is dependent on the relative position of the walls and which communicates with the surroundings through a filling duct of the container, comprising a valve housing with a filling tube, which is insertable into said filling duct of the container to supply a product to the compartment of the container through a product path which is defined by the valve housing and its filling tube, a piston element arranged in the product path and comprising a valve body and, arranged downstream thereof, an end element, the piston element being movable between a first position, in which the valve body abuts against a valve seat of the valve housing to block the product path and the end element is arranged in or adjacent to an outlet portion of the filling tube to counteract dripping, and a second position, in which the valve body is displaced from the valve seat to open the product path and the end element takes a position, in which it defines, together with the outlet portion, a filling passage, wherein the end element projects from the outlet portion of the filling tube when the piston element is arranged in the second position, and a squeezing apparatus which is arranged to grip the filling tube and the filling duct when said filling tube is inserted in said filling duct to establish a seal between the filling tube and the filling duct, said filling tube being made of a rigid material.

2. A device as claimed in claim 1, in which said piston element further comprises a piston rod, the piston rod supporting the valve body and the end element.

3. A device as claimed in claim 1, in which the piston element is movable between said first and second positions by axial displacement of said piston element.

4. A device as claimed in claim 2, wherein the end element is exchangeably arranged in said piston element.

5. A device as claimed in claim 2, wherein the valve body is exchangeably arranged in said piston element.

6. A device as claimed in claim 1, wherein the end element is received in the outlet portion of the filling tube when the piston element is arranged in the first position.

7. A device as claimed in claim 1, in which said filling passage has the form of a circumferential gap.

8. A device as claimed in claim 1, in which the outer diameter of the end element is smaller than the inner diameter of the filling tube.

9. A device as claimed in claim 1, in which said valve body supports a seal, which, when the valve body is arranged in said first position, abuts against the valve seat.

10. A device as claimed in claim 1, in which the end element has the form of a truncated cone.

11. A device as claimed in claim 10, in which the circumferential surface of the truncated conical shape of the end element is curved.

12. A device as claimed in claim 1, in which the end element has a flat surface facing away from the filling tube.

13. A device as claimed in claim 12, in which said flat surface has a profiled surface structure.

14. A device as claimed in claim 1, in which the end element has a circular base.

15. A device as claimed in claim 1, in which the end element has a base with the shape of a convex lens.

16. A device as claimed in claim 1, in which said material is stainless steel.

17. A device as claimed in claim 1, in which the squeezing apparatus comprises elastic engaging surface which are arranged to grip said filling tube and said filling duct.

18. A device as claimed in claim 1, in which the valve housing and the filling tube further comprise a gas duct for supplying a gas to the container.

19. A device as claimed in claim 18, wherein the supply of gas is arranged to be controlled independently of the position of the piston element.

* * * * *